US008043104B2

(12) United States Patent
Taketomi

(10) Patent No.: US 8,043,104 B2
(45) Date of Patent: Oct. 25, 2011

(54) CABLE CONNECTOR

(75) Inventor: Kousuke Taketomi, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/447,968

(22) PCT Filed: Nov. 1, 2007

(86) PCT No.: PCT/US2007/023099
§ 371 (c)(1),
(2), (4) Date: Jan. 5, 2010

(87) PCT Pub. No.: WO2008/057395
PCT Pub. Date: May 15, 2008

(65) Prior Publication Data

US 2010/0130044 A1 May 27, 2010

(30) Foreign Application Priority Data

Nov. 1, 2006 (JP) ..... 2006-297443

(51) Int. Cl.
*H01R 13/15* (2006.01)

(52) U.S. Cl. ..... 439/260; 439/495

(58) Field of Classification Search ..... 439/260, 439/492, 495
See application file for complete search history.

(56) References Cited

U.S. PATENT DOCUMENTS 6,224,418 B1 5/2001 Miura et al.
6,254,406 B1 * 7/2001 Chiu et al. ..... 439/142
7,255,594 B2 * 8/2007 Huang et al. ..... 439/495
7,261,589 B2 * 8/2007 Gillespie et al. ..... 439/495
7,291,039 B2 * 11/2007 Shin ..... 439/495
7,387,528 B2 * 6/2008 Lee et al. ..... 439/495
7,621,768 B2 * 11/2009 Suzuki et al. ..... 439/260
7,727,010 B2 * 6/2010 Liu et al. ..... 439/570
2005/0260885 A1 11/2005 Lu
2007/0105423 A1 5/2007 Gillespie et al.

OTHER PUBLICATIONS

International Search Report and Written Opinion of PCT/US2007/0023099, Apr. 28, 2008.

* cited by examiner

*Primary Examiner* — Thanh Tam Le
(74) *Attorney, Agent, or Firm* — Timothy M. Morella

(57) ABSTRACT

A cable connector (1) for receiving a flexible circuit member (101) includes an insulative housing (11) with a receptacle (13) for receiving the flexible circuit member therein. A plurality of terminals are provided in terminal receiving cavities (14*a*, 14*b*). The housing includes a pair of end portions located at opposite ends of said housing with the end portions having a pair of spaced apart walls (16, 35) to provide flexibility to at least one of said walls. Each the flexible wall has a locking member (30) thereon. An actuator i(21) is mounted on the housing and moveable between first and second operative positions. The flexible circuit member being insertable when the actuator is at the first open position and being engaged by the terminals in an operative manner when the actuator is at the second closed position. The actuator includes an actuator body generally extending along the receptacle when in the second closed position and a locking portion (26) disposed on opposite ends of the actuator body. Each of the housing locking members engaging one of the locking portions disposed on the actuator when the actuator is in the second closed position.

7 Claims, 18 Drawing Sheets

CABLE CONNECTOR

BACKGROUND OF THE INVENTION

The present invention relates to a connector and, more specifically, to a connector for receiving a cable such as a flexible printed circuit.

Conventionally, in order to connect a flexible circuit member, typically referred to as a flexible printed circuit (FPC) or a flexible flat cable (FFC), to another circuit member, a cable connector has been used. (See, for example, Japanese Patent Application Laid-Open (Kokai) No. H10-12331.) For convenience, such FPC and FFC are hereinafter referred to as FPC.

As shown in FIG. 18, the conventional cable connector has a housing 801 made of an insulative material such as a synthetic resin and a plurality of terminals 804 made of a conductive material such as a metal, each of which is held in the housing 801. Further, an actuator 802 made of an insulation material such as a synthetic resin is rotatably mounted on an upper surface of the housing, so that the actuator 802 may rotate between an open position (illustrated in FIG. 18) and a closed position.

A metal plate support fitting member 811 is positioned on each of the opposite sides of the housing 801 and includes a circular shaft bore 812 formed thereon, so that a support shaft 806 projected from each of the respective sides of actuator 802 is rotatably inserted in the shaft bore 812. The actuator 802 can rotate about the support shafts 806 on the opposite sides with respect to the housing 801.

When the actuator 802 is moved to the open position thereof, an FPC may be inserted into the connector from an open front portion of the housing 801. After insertion of the FPC to the back of the housing 801, the actuator 802 is manually rotated to the closed position thereof by a finger or the like of an operator. In such position, a locking projection 807 formed on each side of the actuator 802 is engaged in an engagement hole 813 formed on the metal support fitting member 811 and, therefore, the actuator 802 is locked relative to the housing 801. The FPC is engaged by the locked actuator 802 from above, and conductive contact pads (not shown) on the lower surface of the FPC contacts the terminals 804.

In such a conventional cable connector, upon opening or closing actuator 802, the locking projections 807 of actuator 802 engages against the periphery of the respective engagement holes 813 of the support fitting member 811. Since locking projections 807 are made of plastic and support fitting member 811 is made of metal, the locking projections will eventually be subject to wear. Therefore, the operational durability of the actuator 802 and thus the durability of the entire FPC connector may be degraded.

Another conventional cable connector (not shown) in which a locking projection provided on the actuator engages a plastic locking portion on the housing. According to such a conventional cable connector, the locking projection of the actuator is made of plastic and the locking portion of the housing it engages is similarly made of plastic so that abrasion of the locking projection is reduced. However, in such a conventional FPC connector, the strength of a support member supporting the locking projection must be reduced. In the alternative, if the support member is made thicker in order to improve the strength of the locking portion, the size of the housing must be increased and this in turn brings about an increase in the size of the entire cable connector.

SUMMARY OF THE INVENTION

The present invention was made to solve the foregoing problems of the above-described conventional cable connector, and has an object to provide a small cable connector having a higher operation durability, which includes locking portions provided for a housing so as to have therein a hollow cross section, respectively, and engaged with locked portions disposed on opposite sides of an actuator mounted on the housing so as to be capable of changing its posture between a first position where a FPC is permitted to be inserted in the cable connector, and a second position where conductive wires and terminals of the FPC are permitted to be electrically connected, which is able to disperse a stress applied on the locking portion without abrasion of the locked portion even though the present cable connector has a simple structure; can enhance the strength of the locking portion, can reduce the thickness of the locking portion thinner; and can ensure locking of an actuator to thereby reliably connect the FPC to the cable connector without occurrence of any unnecessary change of a posture of the actuator from the second position.

In order to attain the above-described object, a cable connector according to the present invention is a cable connector, which is mounted on a substrate and comprises: a housing having an insertion port for inserting a FPC therethrough; terminals which are attached on the housing and are electrically connected to a conductive wire of the FPC; an actuator including an actuator body configured to be capable of changing its posture between a first position enabling insertion of the FPC and a second position enabling connection of the conductive wire of the inserted FPC to the terminals, the actuator body being disposed to be approximately parallel with an inserting and extracting direction of the FPC, and locked portions disposed on opposite sides of the actuator body, respectively; and locking portions disposed on opposite sides of the housing so as to be engaged with the locked portion at the second position; wherein the locking portion has a hollow cross sectional shape, in other words, a cross section crossing the insertion and extracting direction of the FPC is hollow.

According to another cable connector, further, the locking portion may include a region having a hollow cross sectional shape with a partially opened portion.

According to a still another cable connector, further, the locking portion may include a locking projection to be engaged with the locked portion in the vicinity of a front end and the region of the hollow cross sectional shape with a partially unlocked portion corresponds to the vicinity of the front end.

According to a still further cable connector, further, the locking portion may include an outside part and an inside part of the housing, an inside step portion which is provided on the inside part, a bottom portion for connecting respective lower ends of the outside and inside parts with each other, a lock support arm portion connected to respective upper ends of the outside part and the inside part, and a locking projection which is formed at a corner portion where the lock support arm portion and the inside part are connected with each other to be engaged with the locked portion.

According to a further cable connector, further, the region having the hollow cross sectional shape with the partially unlocked portion may include an outside part and an inside part of the housing, an inside step portion which is provided on the inside part, a lock support arm portion connected to upper ends of the outside part and the inside part, and a locking projection which is formed at a corner portion where the lock support arm portion and the inside part are connected to each other to be engaged with the locked portion.

According to a further cable connector, further, the outside part may include an approximately triangular notch portion which is formed in a lower end on the inlet side of the outside part.

According to a still further connector for a cable, further, there is provided a cavity portion with a partially unlocked portion, which permits an auxiliary fitting for attaching the connector to be accommodated therein, at least a part of the said auxiliary fitting being arranged to be visually checked through the notch portion.

According to another cable connector, further, the outside part may include a rigidity-adjustable projecting portion which projects into the notch portion.

In accordance with the present invention, the cable connector includes the locking portions of the housing, the locking portions having the hollow cross section, respectively, and being able to be engaged with locked portions disposed on the opposite sides of the actuator attached to the housing so as to be capable of changing its posture between the first position enabling insertion of the FPC and a second position enabling electrical connection of a conductive wire and a terminal. Therefore, the cable connector, in spite of the simple structure thereof, is able to disperse a stress applied to the locking portion without abrasion of the locked portion; to enhance the strength of the locking portion; to make the locking portion thinner; and to reliably connect the FPC due to the reliable locking of the actuator without occurrence of any unnecessary change of a posture the actuator from the second position. Further, the cable connector of the present invention can be small in its size and enhance its durability in use.

DESCRIPTION OF THE PREFERRED EMBODIMENTS

Preferred embodiments of the present invention will be described hereinbelow in detail with reference to the accompanying drawings.

Figure 1:
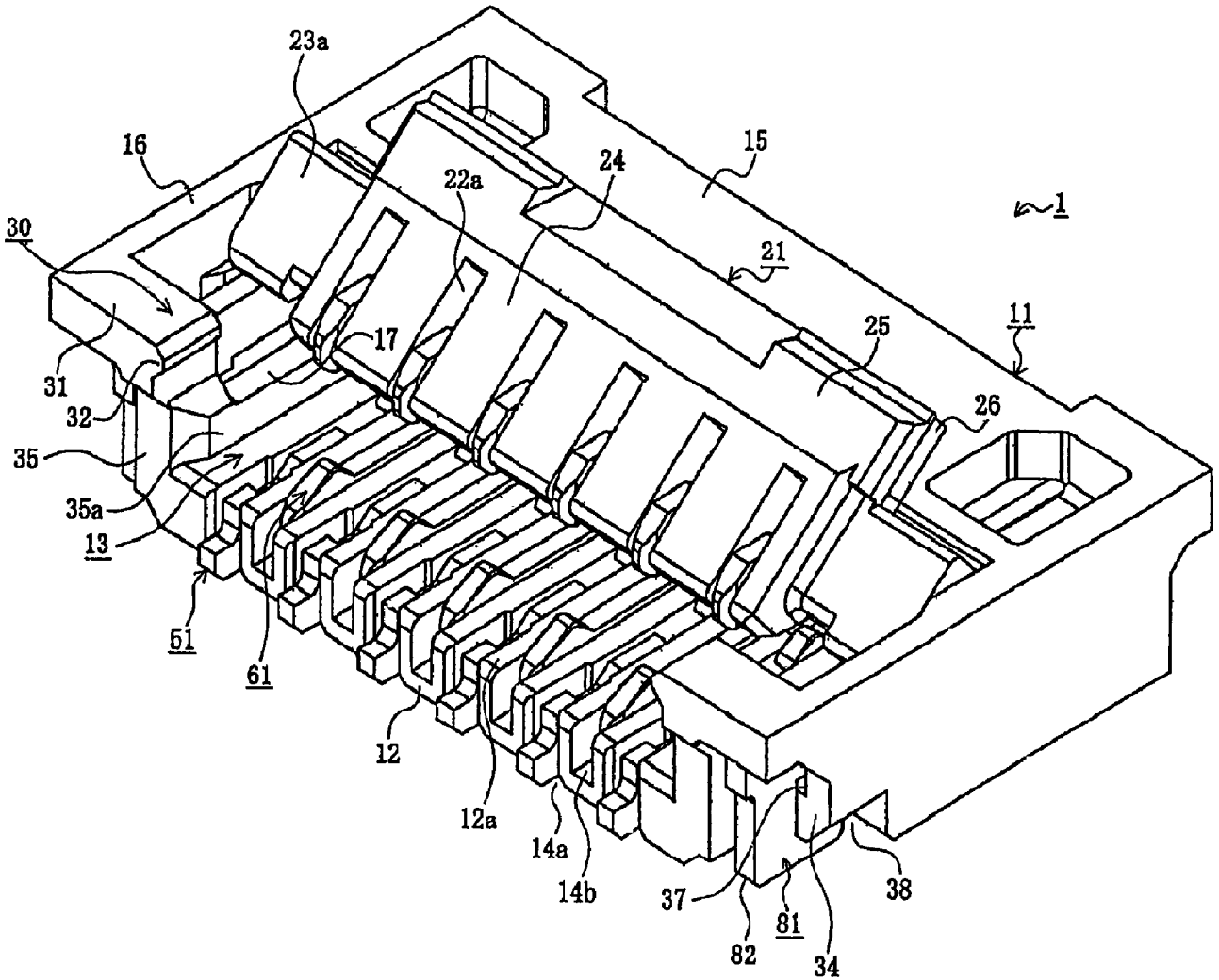
FIG. 1 is a perspective view illustrating a cable connector according to an embodiment of the present invention when an actuator thereof is in an opening position.

Referring to FIG. 1, an FPC connector generally designated 1 according to an embodiment of the present invention is shown and may be mounted on a surface of a substrate or a board (not illustrated) such as a circuit board and is used for electrically connect an FPC or the like. In this case, the bottom surface in FIGS. 4, 5 and 7 through 10 is the surface to be used as a mounting surface by which the connector 1 is mounted on the substrate, and this surface confronts the mounting surface of the substrate. As stated above, the FPC 101 is a generally planar flexible cable, for example, referred to as a FPC and FFC, however, the cable 101 may be any kind of cable as long as it is a plate-like cable provided with a conductive traces or wire. In addition, in this embodiment, representations of directions such as up, down, left, right, front, rear, and the like, used for explaining the structure and movement of each part of the connector 1, and the like, are not absolute, but relative. These representations are appropriate when the connector 1 or its constituent part is in the position shown in the figures. If the position of the connector 1 or its constituent part changes, however, it is assumed that these representations are to be changed according to the change of the position of the connector 1 or its constituent part.

The cable connector 1 includes a one-piece housing 11 which is formed of an insulative material such as a synthetic resin and an actuator 21 which is rotatably mounted on the housing 11 so as to be moveable between an opening position as a first position and a closed position as a second position.

The housing 11 has a lower part 12, an upper part 15, right and left outside parts 16, right and left inside parts 35, and an insertion port or receptacle 13 as an opening, which is formed among the lower part 12, the upper part 15, and the inside part 35 and through which the end of the FPC 101 is inserted or is extracted from its front part (the left part in FIGS. 7 through 10). Further, the FPC 101 is inserted toward right in FIGS. 7 through 10. According to the present embodiment, as a matter of convenience, it is defined that the inlet side of the insertion port 13 (the left side in FIGS. 7 through 10) is referred to as the front side of the connector 1 and the back side of the insertion port 13 (the right side in FIGS. 7 through 10) is referred to as the rear side of the connector 1. In addition, the front and back direction of the connector 1 is referred to as an insertion and extraction direction of the cable. Then, on the back of the insertion port 13, an abutting portion 18 with which the front end of the FPC 101 comes into contact is arranged.

In addition, a plurality of terminal receipt grooves in which a terminal(s) made of a metal is mounted is formed on the housing 11. According to the present embodiment, the terminal may include a first terminal 51 and a second terminal 61 and the terminal receipt groove may include a first terminal receipt groove 14*a* having the first terminal 51 mounted therein and a second terminal receipt groove 14*b* having the second terminal 61 mounted therein. In the example illustrated in the drawing figures, the odd number terminal receipt groove is the first terminal receipt groove 14*a* and the even number terminal receipt groove is the second terminal receipt groove 14*b*. Then, the total of the first terminal receipt groove 14*a* and the second terminal receipt groove 14*b* is eleven, for example, at a pitch about 0.3 (mm). Further, the pitch and the number of the terminal receipt grooves may be appropriately changed. In addition, the first terminal receipt grooves 14*a* and the second terminal receipt grooves 14*b* are alternately arranged so that they are located side-by-side with each other. It is not always necessary that the first terminal 51 and the second terminal 61 are mounted in the all of the first terminal receipt grooves 14*a* and the second terminal receipt grooves 14*b*, and the first terminals 51 and the second terminals 61 may be appropriately omitted in response to the layout of conductive wires 151 provided for the FPC 101.

Figure 11:
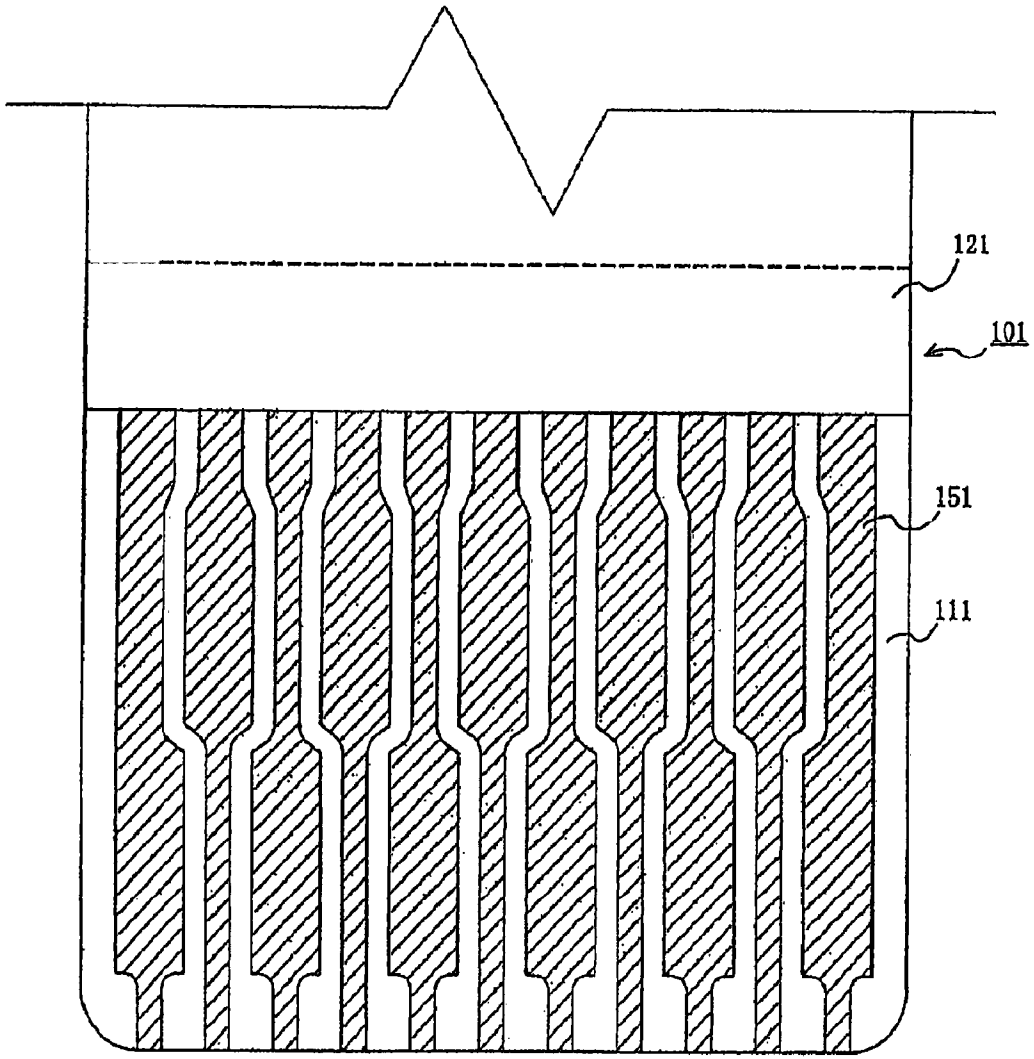
FIG. 11 is a plan view of a cable according to the embodiment of the present invention.

Here, as shown in FIG. 11, the FPC 101 has a substrate portion 111 which is a thin insulating plate member having a long and thin band-like shape and plural number of, for example, eleven conductive wires 151 disposed on one surface of the substrate portion 111. In FIG. 11, it is noted that a portion adjacent to a front end (i.e., the lower end shown in FIG. 11) to be inserted in the insertion port 13 of the connector 1 of the FPC 101 is only illustrated and other portions are omitted. In addition, the conductive wires 151 are foil-like line-shape bodies made of a conductive metal such as copper, for example, and the conductive wires 151 are aligned in parallel at a predetermined pitch, for example, approximately 0.3 (mm). Further, the number and the pitch of the conductive wires 151 may be appropriately changed according to respective needs. Then, the upper side of all of the conductive wires 151 is coated with an insulating layer 121. Further, the insulating layer 121 is removed from an area of a predetermined length from the front end of the FPC 101 and, therefore, the upper surface of the conductive wires 151 is exposed to the exterior.

Moreover, on the upper part of the inside part 35, an inside step portion 17 is formed. This inside step portion 17, as shown in FIG. 1, is a recess portion which is formed in an intermediate part of the upper surface of the inside part 35 and the bottom surface of the recess portion is located higher than an upper surface 12*a* of the lower part 12.

Between the outside part 16 and the inside part 35, an auxiliary fitting accommodating recess portion 39 shaped in a slit (to be described later) elongated in the insertion and extracting direction of the FPC 101 is formed, and an auxiliary metal fitting 81 for use in attaching a connector (hereinafter referred to as merely an auxiliary fitting), commonly known as a fitting nail, is inserted into the auxiliary fitting accommodating recess portion 39 to be attached to the housing 11. The auxiliary fitting 81 is a member having a downwardly projecting part of which a bottom surface 82 functions as a connection surface which is connected to the surface of the substrate and is then fixed on the surface of the substrate by fixing means such as soldering so that the housing 11 is fixedly attached to the substrate. Further, the upper end surface of the auxiliary fitting 81 may function as a support portion for supporting, from a lower side, first shaft portions 23*a* which are formed, respectively, on the opposite sides of an actuator body 25 of the actuator 21. In addition, side faces 35*a* of the right and left inside step portions 17 may function as opposite guide faces when inserting and extracting the FPC 101 into and from the insertion port 13.

Then, on the upper ends at the inlet side ends of the outside part 16 and the inside part 35, there are connected right and left lock support arm portions 31 of respective locking portions 30 which operate so as to lock the actuator 21 on the closing position through engagement thereof with locked portions 26. The right and left lock support arm portions 31 are formed by plate-like members having the front ends directed toward the inside of the housing 11 and extended from the inlet side ends of the right and left outside parts 16 so as to confront to one another. Then, on each front end of the right and left lock support arm portions 31, a locking projection 32 for fastening the locked portion 26 of the actuator 21 is integrally connected. This locking projection 32 is formed in a convex portion, which extends in the insertion and extracting direction of the FPC 101 and is provided with a sharp shape toward the inside of the housing 11.

Figure 4:
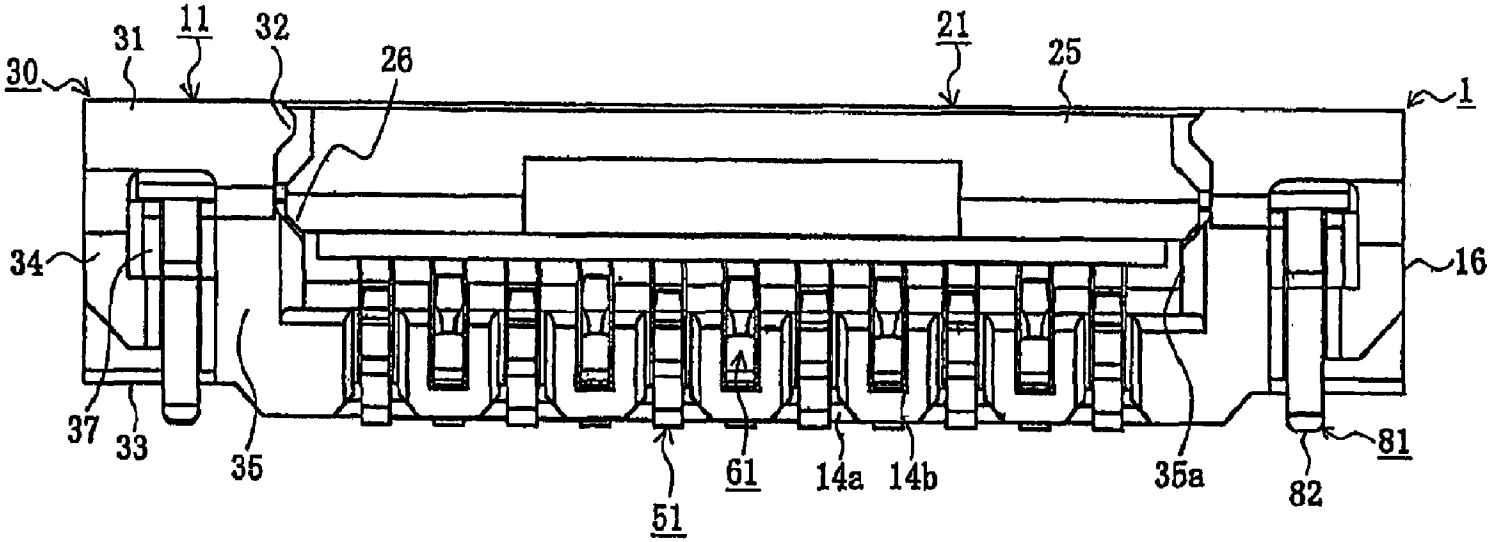
FIG. 4 is a front view of the cable connector according to the embodiment of the present invention when the actuator thereof is in the closing position.
Figure 5:
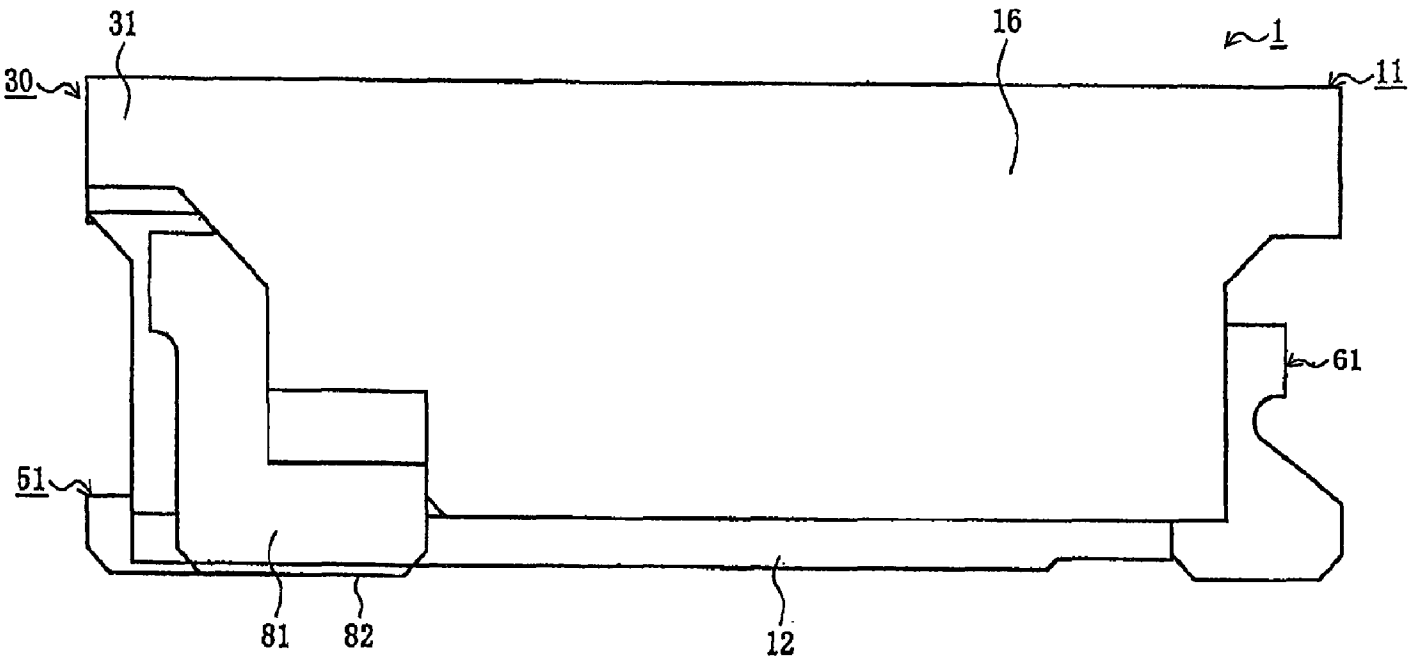
FIG. 5 is a side view of the cable connector according to the embodiment of the present invention when the actuator is in the closing position.

The lock support arm portion 31, the outside part 16, and the inside part 35 are mutually connected so as to define a cavity portion 37 in its inside. This cavity portion 37 may configure the inlet side end of the auxiliary fitting accommodating recess portion 39, however, as shown in FIG. 4, the cavity portion 37 is larger than the auxiliary fitting 81, so that the cavity portion 37 has no function to hold the auxiliary fitting 81.

In addition, on the lower end of the inlet side of the outside part 16, a notch portion 38 in an approximately triangular shape is formed and the outside part 16 is partially cut out. By forming the notch portion 38, a second-order section modulus of the inlet side end face of the locking portion 30 is lowered and this enables to lower a rigidity of the locking portion 30. As a result, by adjusting the size and the shape of the notch portion 38, the rigidity of the locking portion 30 can be adjusted.

Figure 6:
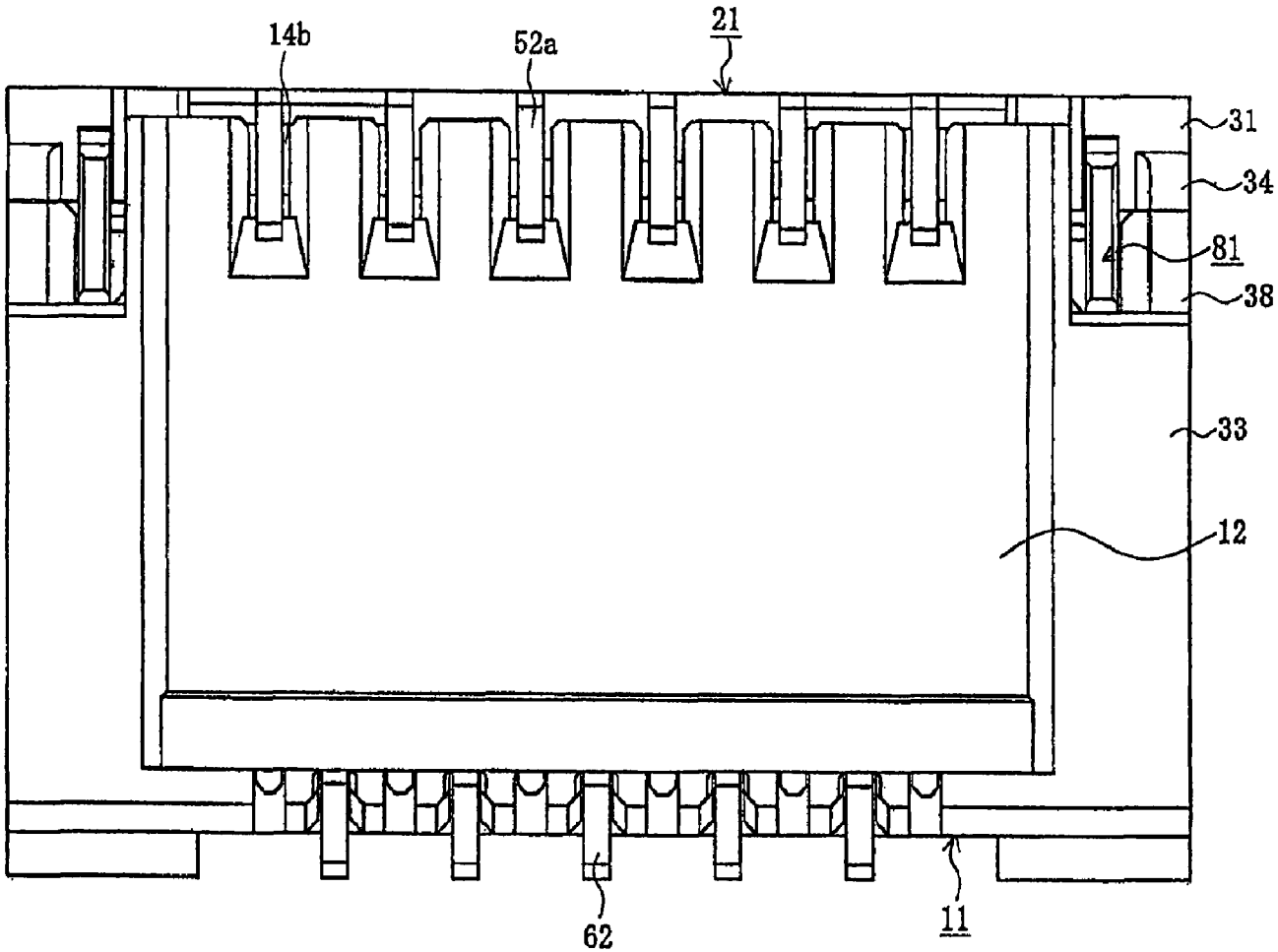
FIG. 6 is a bottom view of the cable connector according to the embodiment of the present invention when the actuator of is in the closing position.

Further, a rigidity-adjustment projecting portion 34, which is formed so as to project into the notch portion 38; is integrally connected to the outside part 16. By forming the rigidity-adjustment projecting portion 34, the rigidity of the inlet side end of the outside part 16 can be improved and the rigidity of the locking portion 30 can be improved. Accordingly, by adjusting the size and the shape of the rigidity-adjustment projecting portion 34, the rigidity of the locking portion 30 can be adjusted. Further, the lower end of the outside part 16 is connected to the lower end of the inside part 35 by a bottom plate portion 33 on the back side from the inlet side end. Then, the bottom plate portion 33, as shown in FIG. 6, is provided with a long rectangular shape which extends in the insertion and extracting direction of the FPC 101 and this inlet side end coincides with the lower end of the notch portion 38.

In other words, the locking portion 30 according to the present embodiment may include respective members such as the lock support arm portion 31, the inside part 35, the outside part 16, the inside step portion 17, and the bottom plate portion 33; and the notch portion 38, the rigidity-adjustment projecting portion 34, and the cavity portion 37, respectively. In addition, the locking portion 30 has the locking projection 32, which is formed at a corner part where the lock support arm portion 31 and the inside part 35 are mutually connected.

Then, by adjusting the size and shape of the respective members that configure the locking portion 30 and that of the cavity portion 37, the rigidity of the locking portion 30 can be adjusted and a degree of elastic deformation exhibited by the locking portion 30 can be adjusted. Further, it is possible to also adjust operability for locking the actuator 21 at the closing position thereof and sureness of locking and the like.

On the other hand, the actuator 21 has the actuator body 25 which is a thick plate-like member shaped in an approximately rectangle, a plurality of terminal accommodating recess portions 22*a* and 22*b* formed in the actuator body 25, the first shaft portions 23*a* which are formed so as to project from the opposite sides of the actuator body 25 outward, the locked portions 26 which are formed so as to protrude outward from the opposite sides of the actuator body 25 in a manner similar to the first shaft portion 23*a*, and pressing portions 24 which are disposed on the lower surface of the actuator body 25. When the actuator 21 is in the closing position, the respective pressing portions 24 may downwardly press the FPC 101 which is inserted from the insertion port 13, namely, in a direction toward the lower part 12. Further, it is to be noted that the pressing portion 24 enables insertion of the FPC 101 when the actuator 21 is in the opening position.

Figure 7:
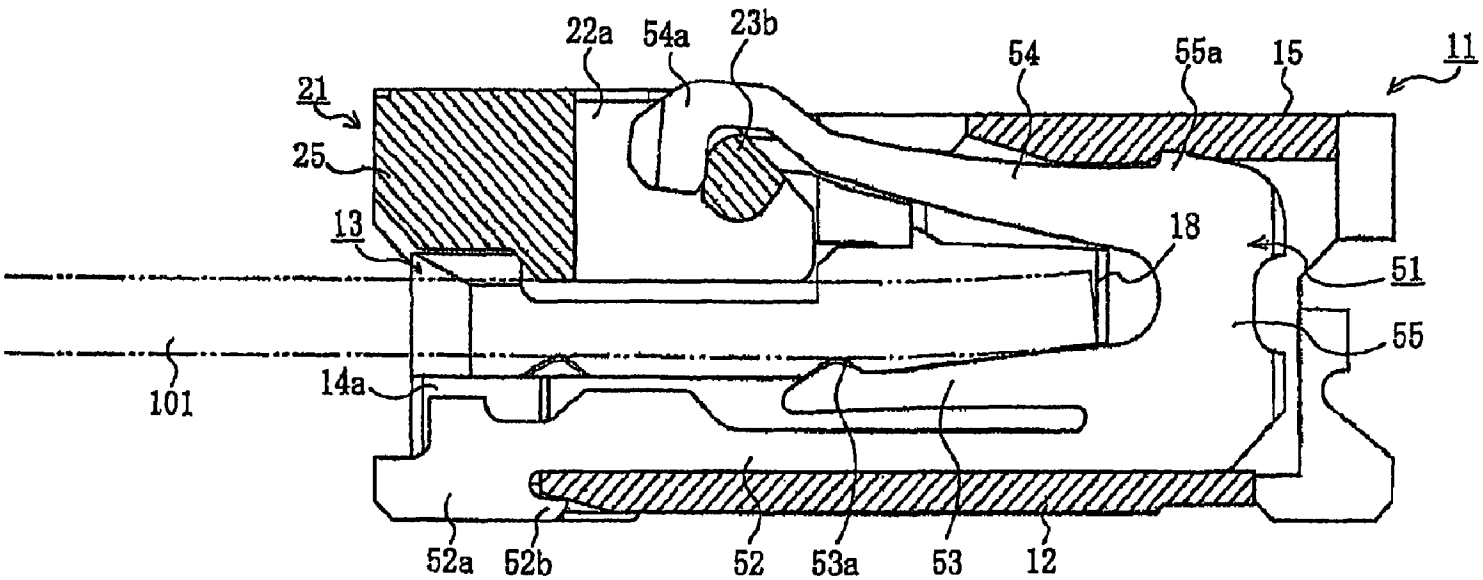
FIG. 7 is a cross sectional view of the cable connector according to the embodiment of the present invention, taken along the line A-A of FIG. 3 and illustrating a state where the actuator thereof is in the closing position.
Figure 9:
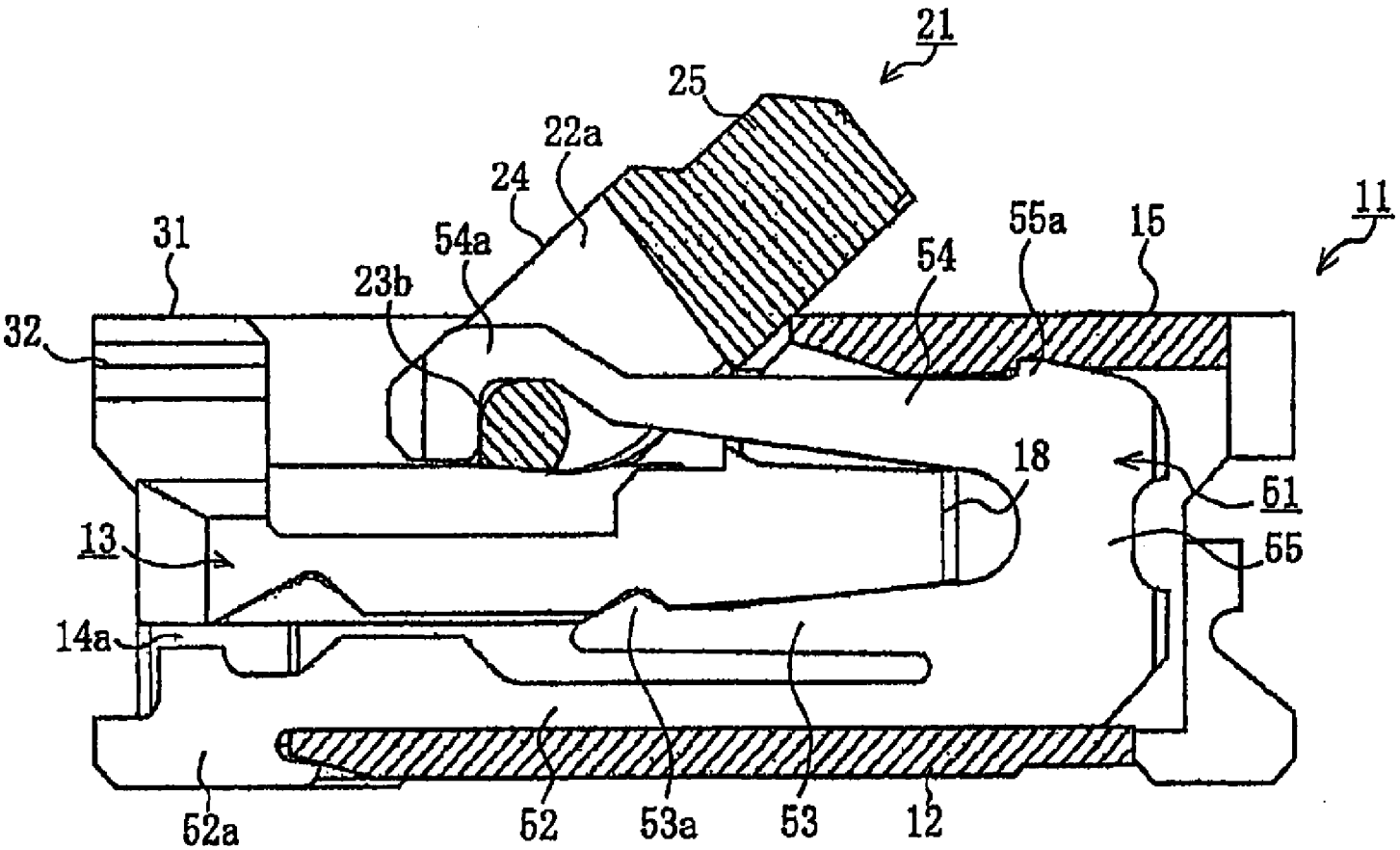
FIG. 9 is a cross sectional view of the cable connector according to the embodiment of the present invention, similar to FIG. 7 and illustrating a state where the actuator is in the opening position.

Further, the terminal accommodating recess portions 22*a* and 22*b* may include first terminal accommodating recess portions 22*a* having bearing portions 54*a*, respectively, on the front end of an upper arm portion 54 of every first terminal 51 accommodated therein and second terminal accommodating recess portions 22*b* having fastening portions 64*a*, respectively, on the front end of every upper arm portion 64 of the second terminals 61 accommodated therein. Then, the numbers and the positions of the first terminal accommodating recess portions 22*a* and the second terminal accommodating recess portions 22*b* may correspond to the first terminal receipt grooves 14*a* and the second terminal receipt grooves 14*b*. In addition, as shown in FIG. 7 and FIG. 9, a second axial portion 23*b* as an axle portion of the actuator 21 is arranged in the first terminal accommodating recess portions 22*a* so that the second axial portion 23*b* is engaged with the bearing portions 54*a*. By means of the bearing portions 54*a*, upward movement of the second axial portion 23*b* is restricted. Therefore, the actuator 21 is prevented from being separated apart from the housing 11 by means of the bearing portions 54*a*.

Figure 2:
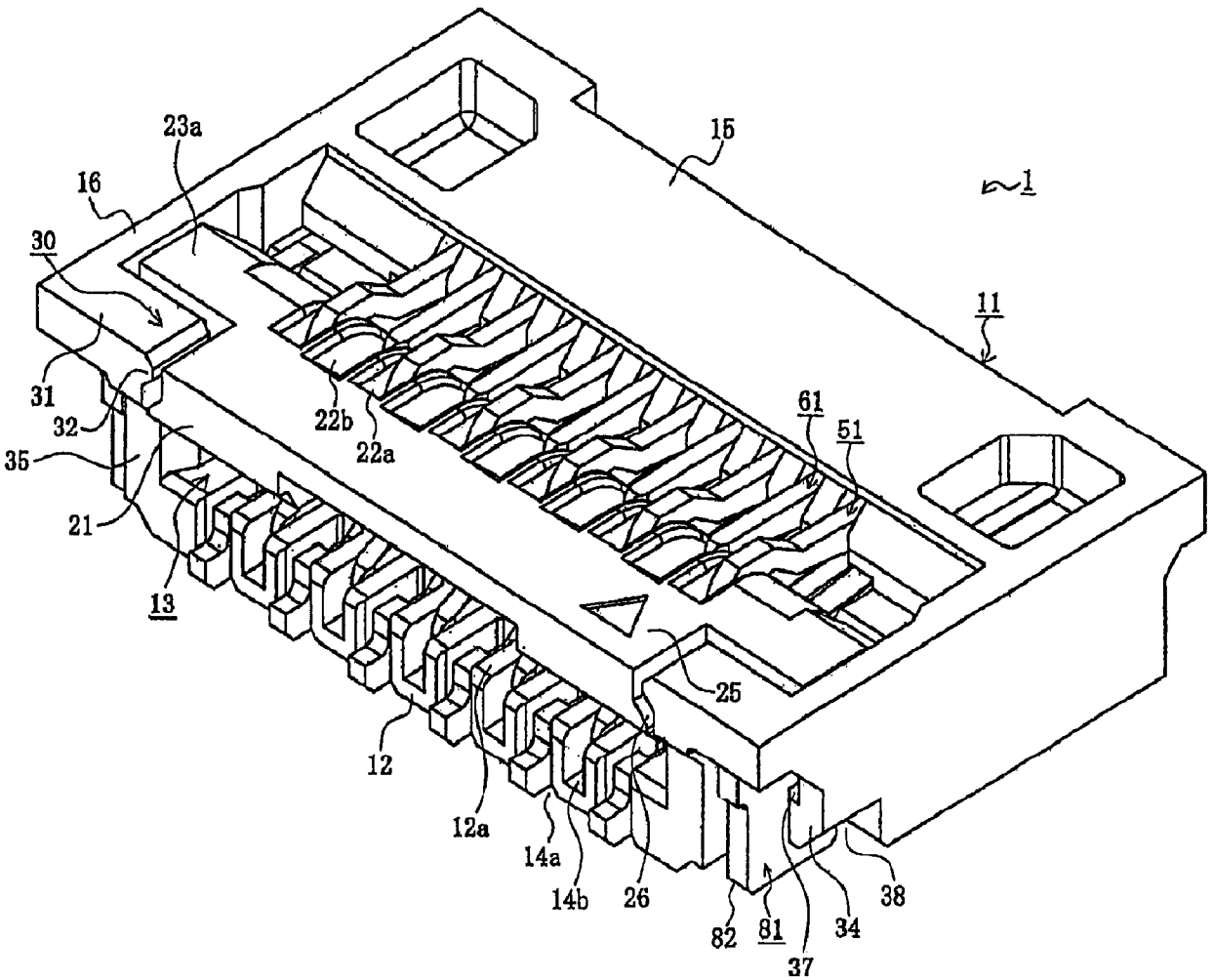
FIG. 2 is a perspective view illustrating the cable connector of the embodiment of the present invention when the actuator thereof is in a closing position.

Then, as shown in FIG. 2, the actuator body 25 is located appropriately in parallel with the inserting and extracting direction of the FPC 101 when the actuator 21 is in the closing position, and as shown in FIG. 1, the front end of the actuator 21 is widely opened so as to be inclined toward the back part of the connector 1 when the actuator 21 is in the opening position.

In addition, the above-mentioned respective locked portions 26 are formed at positions which are located frontward from the first shaft portion 23*a* at the time when the actuator 21 is in the closing position so as to be engaged with the locking projections 32. In this case, as shown in FIGS. 2 and 4, the locking projections 32 come to be situated on the locked portions 26 so as to prevent the actuator 21 from changing its posture from the closing position to the opening position. In other words, the locked portions 26 and the locking projections 32 may function as a locking mechanism for locking the actuator 21 at the closing position and preventing unlocking of the actuator 21. Each locked portion 26 is formed to be lowered from the outside surface of the actuator body 25 by one step, and when the front edge of each locking projection 32 is situated on the corresponding locked portion 26 to lock it, the locking projection 32 does not come above the upper side of the actuator body 25 of the actuator 21. Therefore, it is possible to control the height of the connector 1.

As shown in FIGS. 7 and 9, each first terminal 51 is provided with a linear connection chip 52, which is elongated in the inserting and extracting direction of the FPC 101, a lower arm portion 53 as the linear first arm portion extending in the inserting and extracting direction on the upper side of the connection chip 52, an upper arm portion 54 as the linear second arm portion extending in the inserting and extracting direction on the upper side of the lower arm portion 53, and a connection portion 55 which extends in a direction perpendicular to the inserting and extracting direction and is connected to the connection portions of a base portion of the connection chip 52, a base portion of the lower arm portion 53, and a base portion of the upper arm portion 54.

Here, it is to be noted that a tail portion 52*a* as a connection portion for a substrate which projects downward to be connected to a connection pad formed on the surface of the substrate by means of soldering and the like is connected to the front end (the left end in FIGS. 7 and 9) of the connection chip 52. Further, a projection 52*b* projecting backward is formed in the rear end of the tail portion 52*a*, and a spine 55*a* in the form of a projection is formed on the upper edge of the connection portion 55.

Furthermore, the lower arm portion 53 is formed so as to be branched from the base portion of the connection chip 52 and the lower arm portion 53 may function as a contact piece to be electrically connected to the conductive wire 151 of the FPC 101. The lower arm portion 53 is provided with a contact portion 53*a* functioning as an electrically contactable portion which is formed to project upward on its front end. Further, the bearing portion 54*a* on the front end of the upper arm portion 54 is engaged with the second axial portion 23*b* of the actuator 21.

Then, the first terminal 51 is inserted from the front side (the left side in FIGS. 7 and 9) of the housing 11 into the first terminal receipt groove 14*a* to be mounted therein. In this case, the approximately linear lower end portion of the connection chip 52 comes into contact with the floor surface of the first terminal receipt groove 14*a*, the projecting spine 55*a* grips the lower surface of the upper portion 15 of the housing 11, and further, the projection 52*b* of the tail portion 52*a* grips the lower end of the front end surface on the lower part 12 of the housing 11. Therefore, the first terminal 51 is fixedly positioned at a predetermined position in the housing 11.

Figure 8:
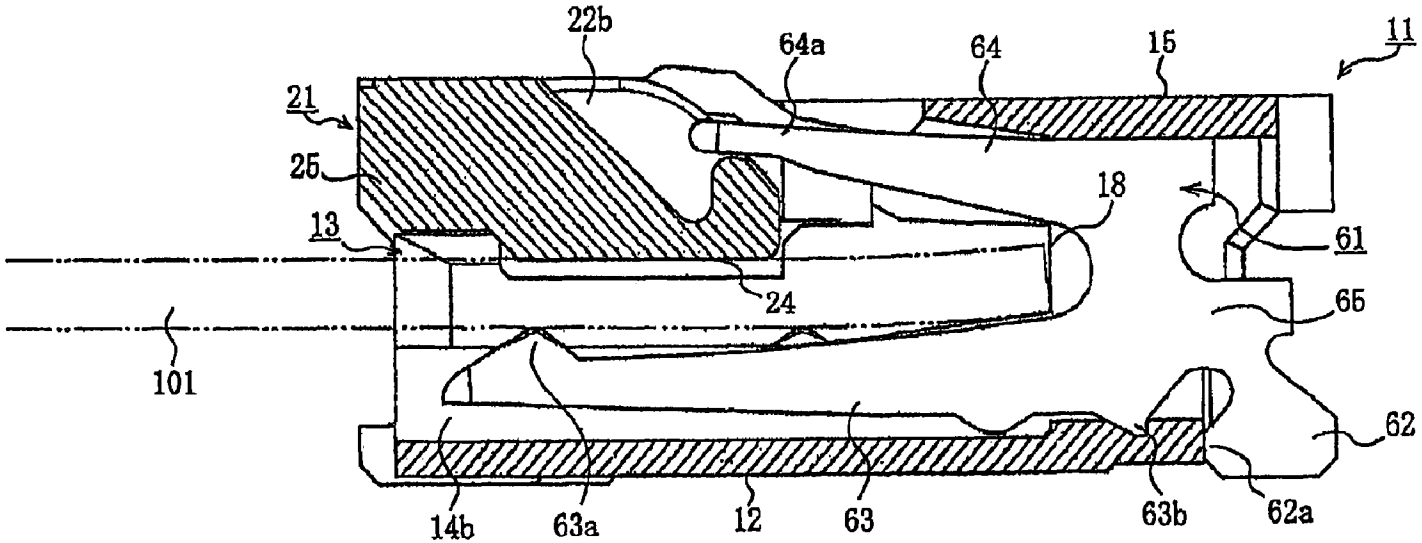
FIG. 8 is a cross sectional view of the cable connector according to the embodiment of the present invention, taken along a line B-B of FIG. 3 and illustrating a state where in the actuator thereof is in the closing position.
Figure 10:
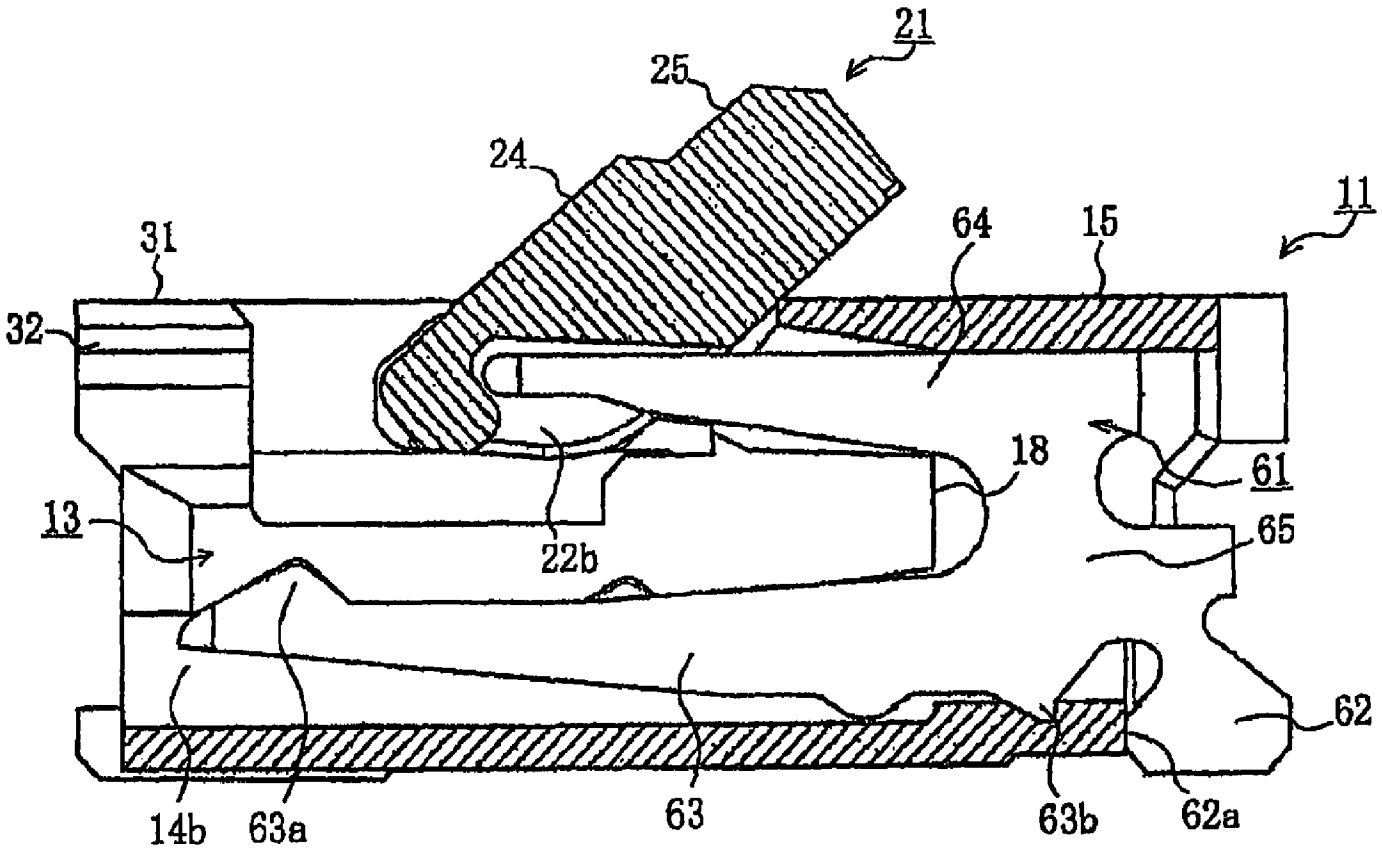
FIG. 10 is a cross sectional view of the cable connector according to the embodiment of the present invention, similar to FIG. 8 and illustrating a state where the actuator is in the opening position.

Further, as shown in FIGS. 8 and 10, each of the second terminals 61 has an approximately U-shape and is provided with a lower arm portion 63 as a first arm portion which extends in the inserting and extracting direction of the FPC 101, an upper arm portion 64 as a second arm portion, and a connection portion 65 extending in a direction perpendicular to the inserting and extracting direction for connecting the base portion of the lower arm portion 63 to the base portion of the upper arm portion 64.

Here, it is to be noted that the lower arm portion 63 may function as a contact piece which is electrically connected to the conductive wire 151 of the FPC 101 and the lower arm portion 63 is provided with a contact portion 63*a* as an electrically contactable portion which projects upward in the vicinity of the front end (the left end in FIGS. 8 and 10). In addition, on the rear end of the connection portion 65, there is provided a tail portion 62 functioning as a connection portion for a substrate, which projects downward to be capable of being connected, by means of soldering and the like, to a connection pad formed in the surface of the substrate. Further, in the base portion of the lower arm portion 63, a projecting spine 63*b* is formed, which projects downward, and also an abutting portion 62*a* is formed in the front end of the tail portion 62.

In addition, a fitting portion 64*a* formed in the front end of the upper arm portion 64 comes into the second terminal accommodating recess portion 22*b* when the actuator 21 reaches the opening position.

Then, the second terminal 61 is inserted from the rear side of the housing 11 (the right side in FIGS. 8 and 10) into the second terminal receipt groove 14*b* so as to be fitted therein. In this case, the approximately linear upper end portions of the upper arm portion 64 and the connection portion 65 may come in contact with the lower surface of the upper part 15 of the housing 11, the projecting spine 63*b* grips a portion of the floor surface of the second terminal receipt groove 14*b*, and further, the abutting portion 62*a* abuts against the rear end surface of the lower part 12 of the housing 11. Thus, the second terminal 61 is fixed at a predetermined position in the housing 11.

Figure 3:
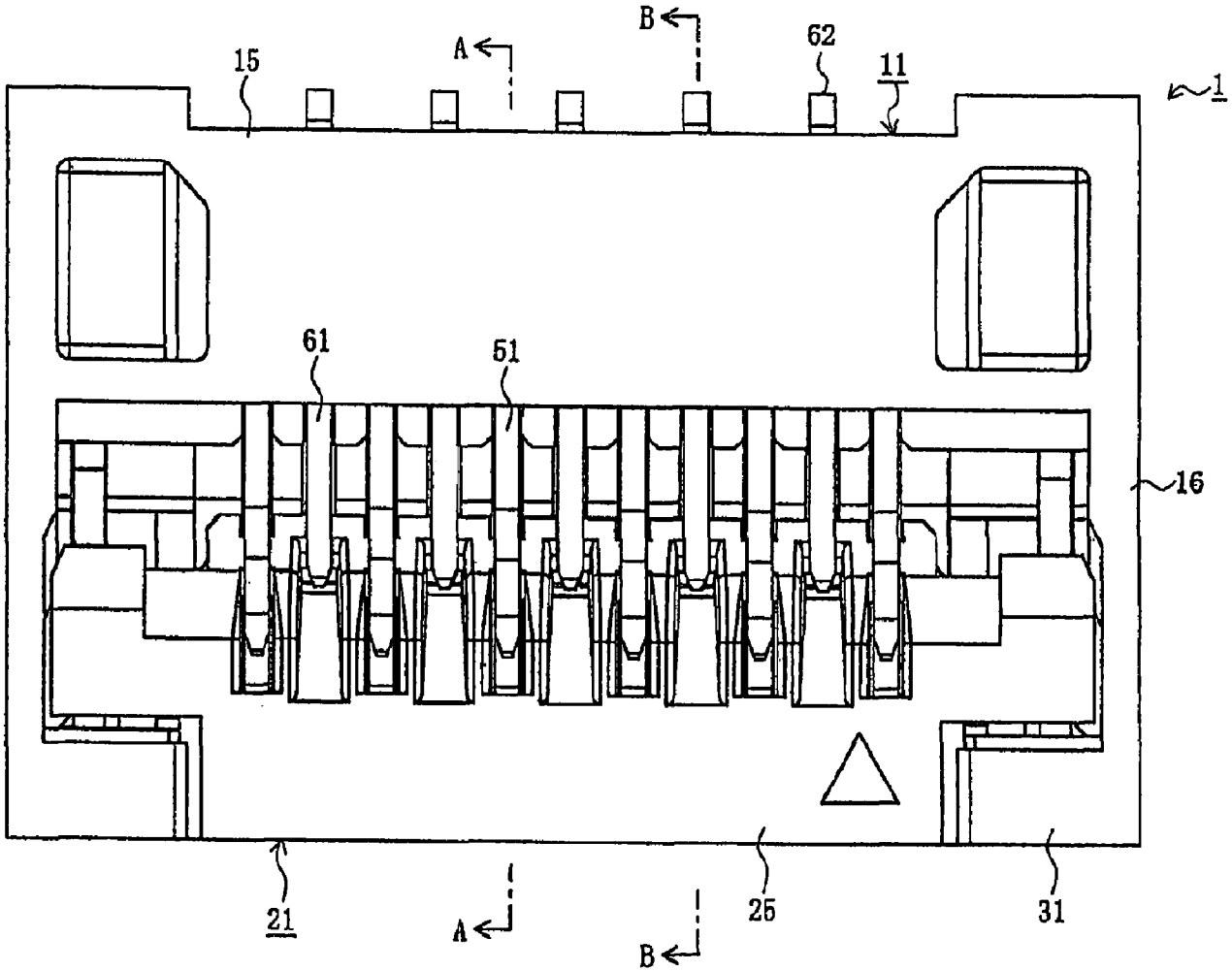
FIG. 3 is a plan view of the cable connector according to the embodiment of the present invention when the actuator thereof is in the closing position.

At this stage, in the first terminal 51, the tail portion 52*a* is arranged at the front end of the housing 11, and on the contrary, in the second terminal 61, the tail portion 62 is arranged at the rear end of the housing 11. Then, the first terminal 51 and the second terminal 61 are alternately mounted in the housing 11 as described above. Therefore, the tail portion 52*a*, the tail portion 62, and the connection pads and the like, which are formed in the mounting surface of the substrate so as to correspond to the tail portion 52*a* and the tail portion 62 are arranged in a staggering manner to be alternately shifted in a vertical direction (a longitudinal direction in FIGS. 3 and 6) with respect to a direction in which the terminals are arranged (a lateral direction in FIGS. 3 and 6) when viewed from the upper side of the connector 1. Therefore, even if a pitch between the neighboring first and second terminals 51 and 61 is narrow, it is possible to provide a spacing between the tail portion 52*a* and the tail portion 62 and respective distances among the connection pads and the like corresponding to these tail portions wider. As a result, the connection pads and the like can be easily produced and even in the case of soldering the tail portion 52*a* and the tail portion 62 with the connection pads and the like corresponding to these tail portions, no solder bridge occurs, so that occurrence of a short circuit between the adjacent connection pads and the like may be prevented.

Further, in the first terminal 51, the position of the contact portion 53*a* with respect to the inserting and extracting direction of the FPC 101 is located nearer to the rear end of the housing 11 rather than the position of the contact portion 63*a* of the second terminal 61 because, as shown in FIG. 11, the positions of the contact portion 53*a* of the first terminal 51 and the contact portion 63*a* of the second terminal 61 are arranged in the staggering manner in order to make the width of the respective ends of the conductive wires 151 of the FPC 101 larger. In other words, in the case of arranging the ends of the conductive wires 151 on the same one line in a width direction of the FPC 101, if the widths of the ends are made larger, the ends are brought into contact with each other and thus, in order to prevent this, it is necessary to alternately arrange the neighboring ends back and forth in the staggering manner and as a result, the contact portions to be brought into contact with the ends are also required to be arranged in the staggering manner. Further, by making the width of the end of the conductive wire 151 larger in this way, it is possible to prevent a dropout at a contact point of the contact portions 53*a* and 63*a*.

As shown in FIG. 1, when the actuator 21 is in the opening position, the pressing portion 24 is directed obliquely upward. Since the spacing between the actuator 21 and the contact portion 53*a* of the first terminal 51 and the spacing between the actuator 21 and the contact portion 63*a* of the second terminal 61 are sufficiently wide, the end of the FPC 101 is inserted from the insertion port 13 either without receiving any contact pressure from the contact portion 53*a* and the contact portion 63*a* or receiving a small amount of contact pressure, and accordingly, a ZIF (Zero Insertion Force) structure is substantially realized.

Next, the structure of the locking portion 30 will be described in detail.

Figure 12:
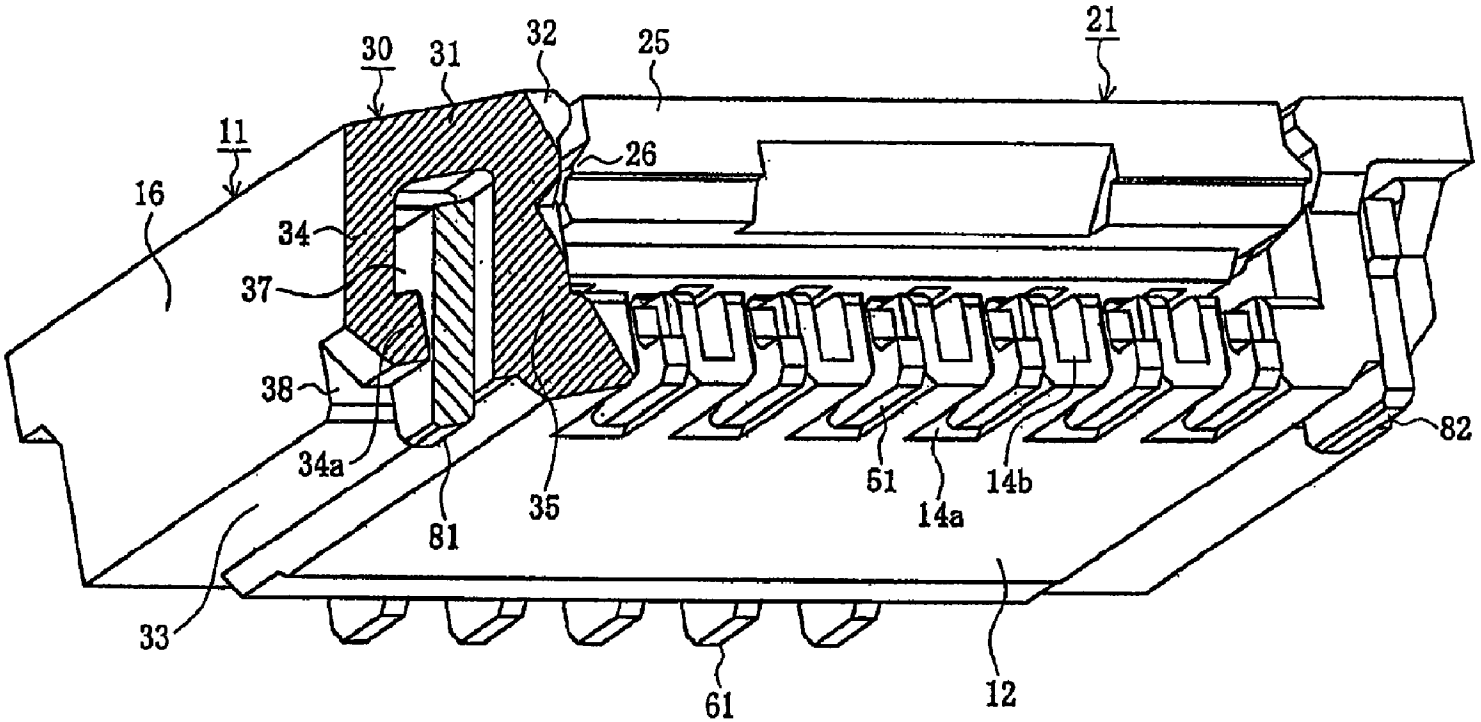
FIG. 12 is a partial cross sectional view of the cable connector according to the embodiment of the present invention, when the actuator thereof is in the closing position.
Figure 13:
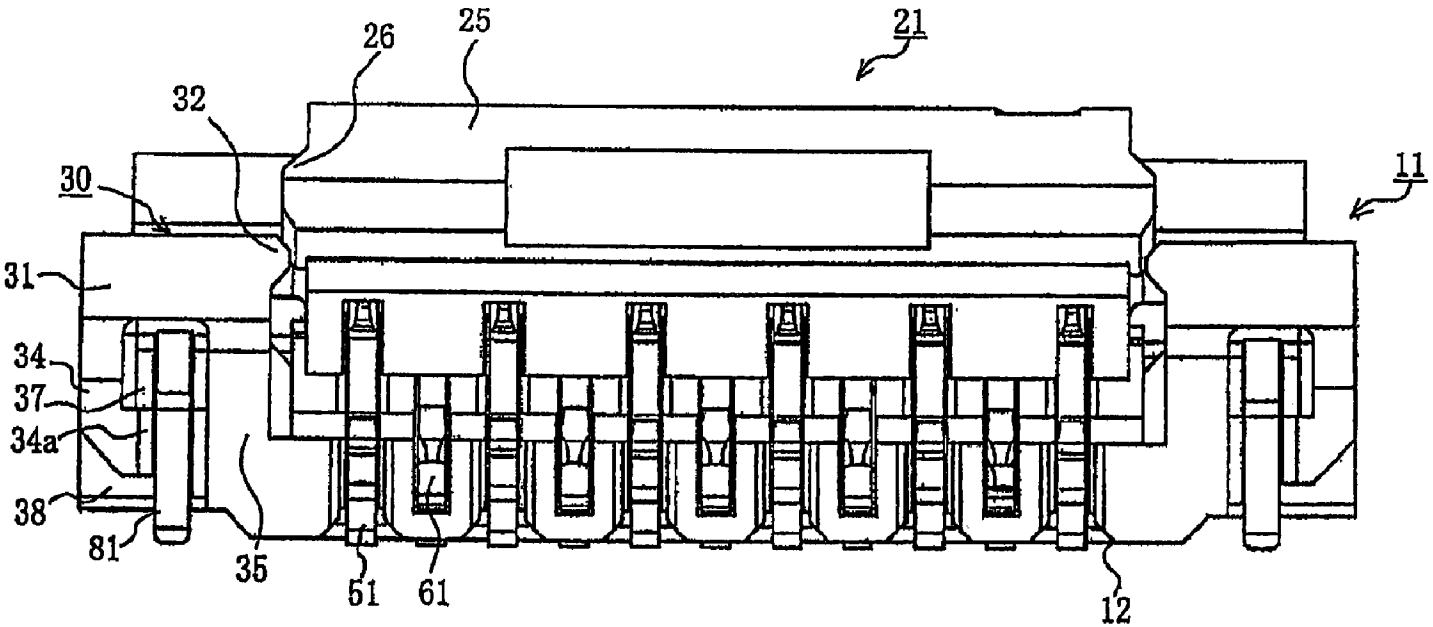
FIG. 13 is a first front view illustrating a state where the actuator of the cable connector according to the embodiment of the present invention shifts from an unlocked state into a locked state.
Figure 14:
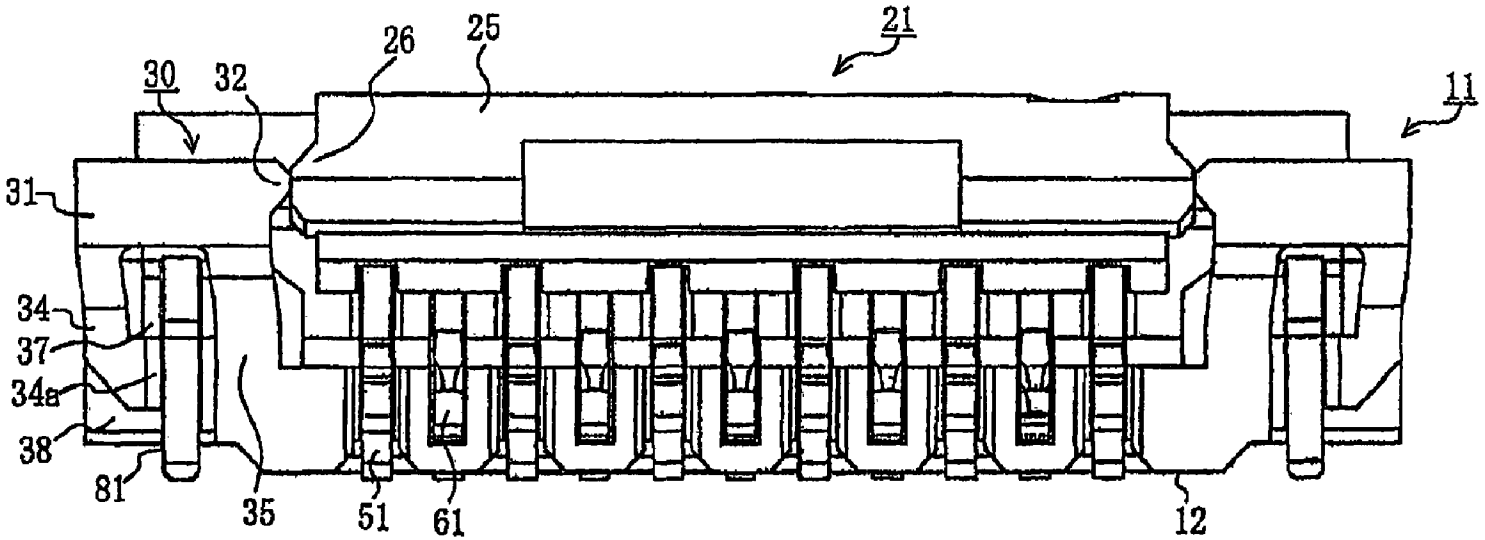
FIG. 14 is a second front view of the cable connector according to the embodiment of the present invention, illustrating a state where the actuator shifts from the unlocked state into the locked state.
Figure 15:
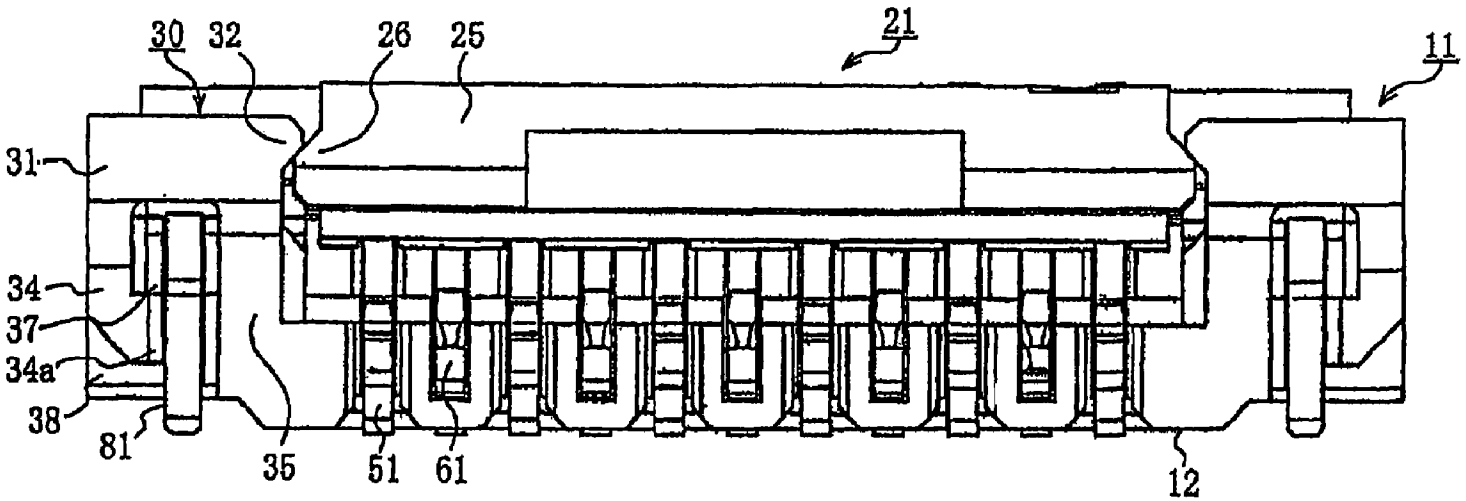
FIG. 15 is a third front view of the cable connector according to the embodiment of the present invention, illustrating a state where the actuator is shifted from the unlocked state into the locked state.
Figure 16:
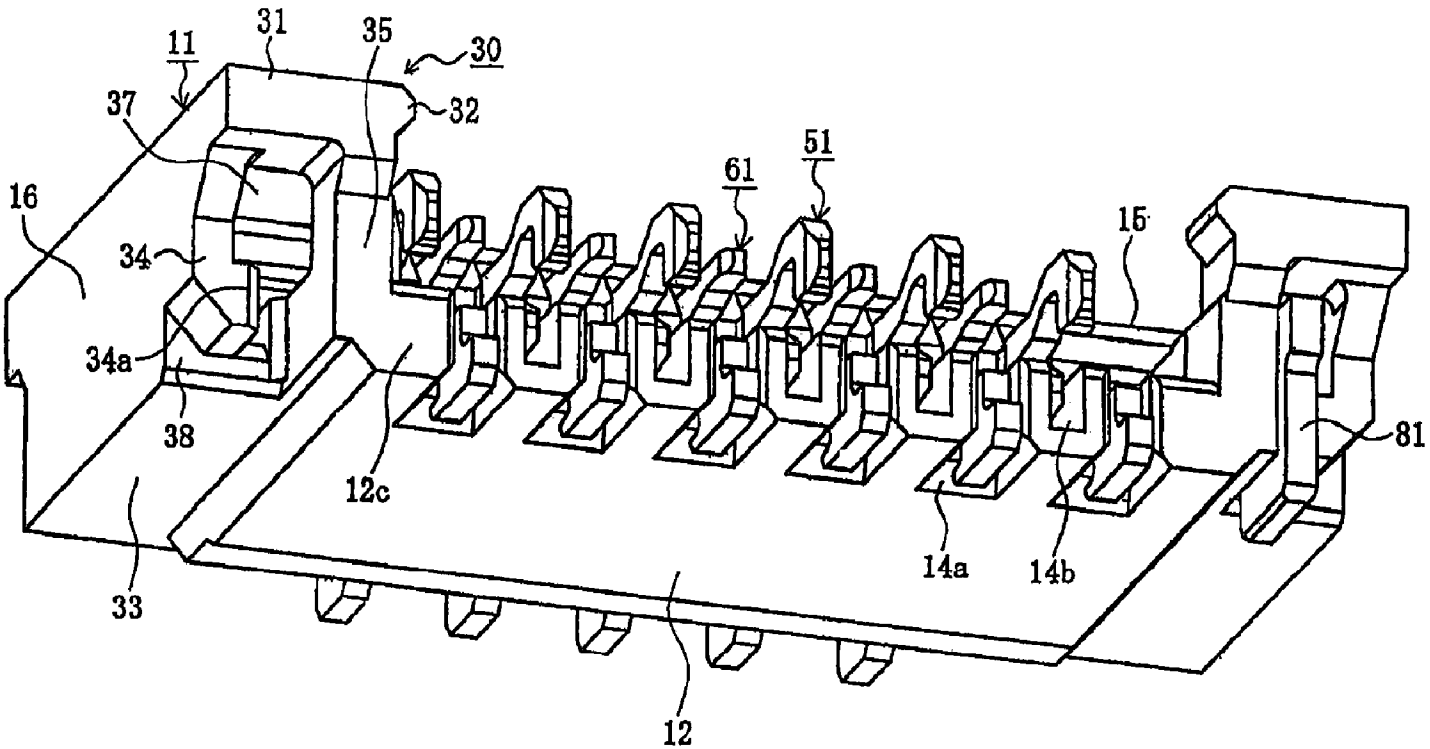
FIG. 16 is a first perspective view showing the state that the actuator of the cable connector according to the embodiment of the present invention is removed.
Figure 17:
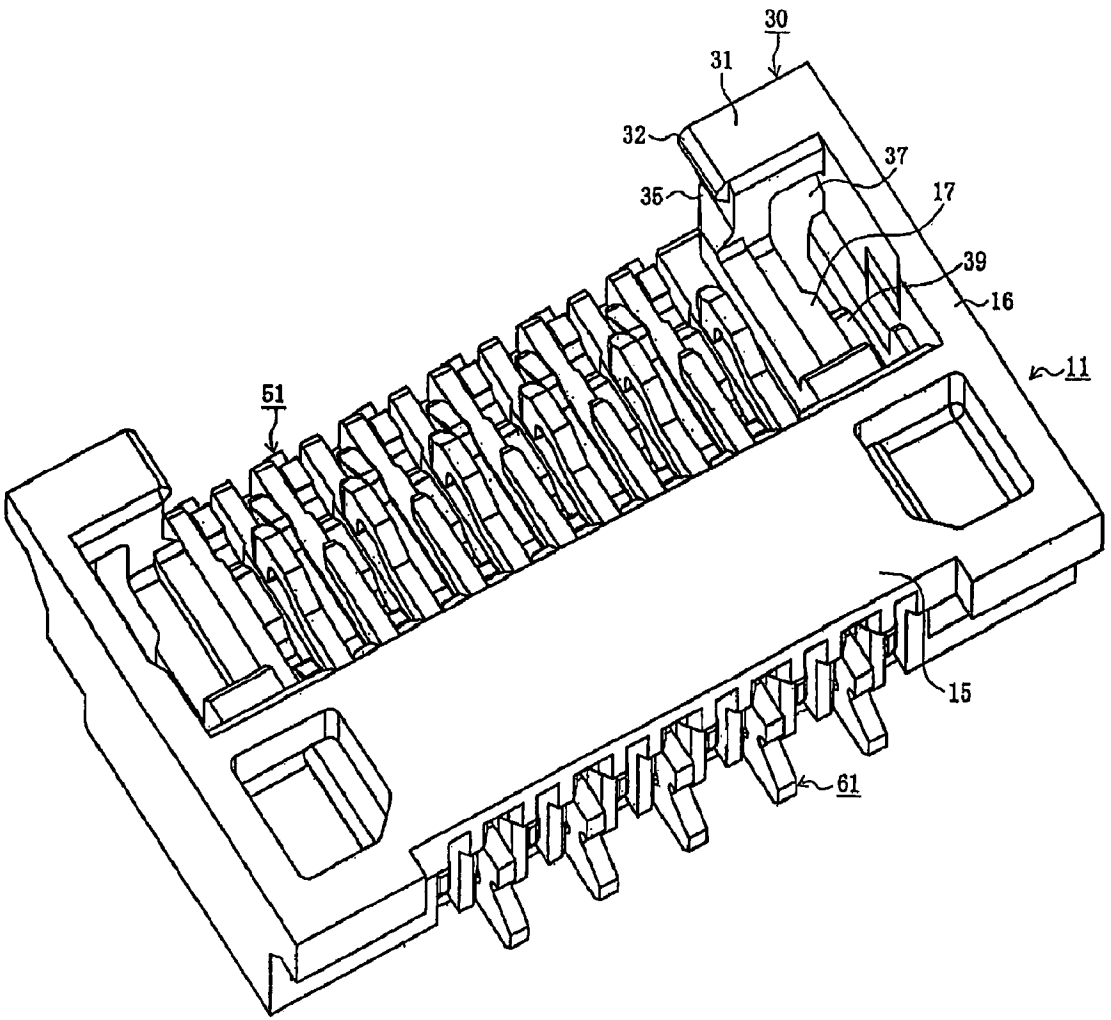
FIG. 17 is a second perspective view showing the state that the actuator of the cable connector according to the embodiment of the present invention is removed.
Figure 18:
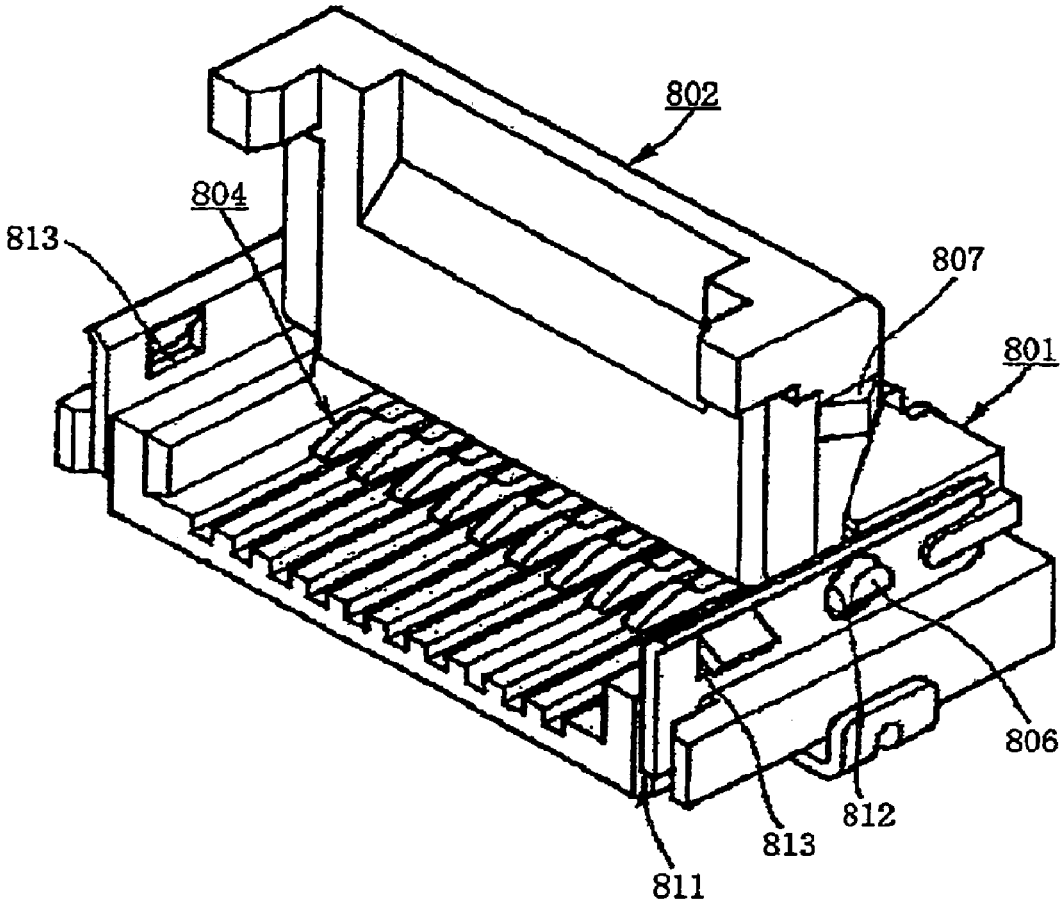
(Prior art) FIG. 18
FIG. 18 is a perspective view showing a conventional cable connector.

FIG. 12 is a partial cross sectional view of the cable connector according to the embodiment of the present invention, when the actuator thereof is in the closing position, FIG. 13 is a first front view illustrating a state where the actuator of the cable connector according to the embodiment of the present invention shifts from an unlocked state into a locked state, FIG. 14 is a second front view of the cable connector according to the embodiment of the present invention, illustrating a state where the actuator shifts from the unlocked state into the locked state, FIG. 15 is a third front view of the cable connector according to the embodiment of the present invention, illustrating a state where the actuator is shifted from the unlocked state into the locked state, FIG. 16 is a first perspective view showing the state that the actuator of the cable connector according to the embodiment of the present invention is removed, and FIG. 17 is a second perspective view showing the state that the actuator of the cable connector according to the embodiment of the present invention is removed.

As described above, in the locking portion 30, the locking projection 32 is formed at a corner portion where the lock support arm portion 31 and the inside part 35 are mutually connected to one another and, the lock support arm portion 31 connects the outside part 16 to the inside part 35 on the inlet side upper ends of the opposite side parts of the actuator, however, the inlet side lower ends of the same opposite side parts are not connected to each other. Therefore, as shown in FIG. 12, when viewing the cross section extending across the inserting and extracting direction of the FPC 101 in the vicinity of the inlet side ends of the outside part 16 and the inside part 35, it is known that the locking portion 30 has a hollow and approximately rectangular cross sectional shape which is formed by the lock support arm portion 31, the inside part 35, and the outside part 16 with its lower side being opened, and the locking portion 30 encircles and defines the cavity portion 37. The locking portion 30 having the described cross sectional structure can have a large second-order section modulus, so that even when the structural members thereof are not formed to have a large thickness, respectively, the rigidity and strength of the locking portion 30 can be high. Accordingly, when the locking portion 30 is elastically displaced, a high coefficient of elasticity of the locking portion 30 is exhibited and thus, the actuator 21 is surely and reliably locked.

Then, since the rigidity-adjustment projecting portion 34 is integrally connected to the inlet side end of the outside part 16, particularly, in the region of this rigidity-adjustment projecting portion 34, it is understood that the entire cross sectional area of the locking portion 30 is wider as compared to the case that the rigidity-adjustment projecting portion 34 is not connected integrally to the inlet side end of the outside part 16. Therefore, a second-order section modulus thereof is large, so that it is possible to improve the rigidity and the strength of the locking portion 30. Further, on the lower end of the rigidity-adjustment projecting portion 34, a rib portion 34*a* projecting toward the inside part 35 is integrally formed. By forming the rib portion 34*a*, not only the strength of the rigidity-adjustment projecting portion 34 itself is improved but also the rigidity-adjustment projecting portion 34 is made similar to the shape where the cross section of the locking portion 30 is closed. Therefore, a second-order section modulus thereof is large, so that the rigidity and the strength of the locking portion 30 can be further improved.

In addition, assuming that the cross section of the locking portion 30 is inclined than that shown in FIG. 12, in other words, supposing the state that the locking portion 30 is cut on a surface connecting from the lock support arm portion 31 up to the front end of the bottom plate portion 33, it can be understood that the locking portion 30 has a completely closed and approximately rectangular hollow sectional shape, which is formed by the lock support arm portion 31, the inside part 35, the outside part 16, and the bottom plate portion 33 to encircle the cavity portion 37. Thus, since the locking portion 30 is also provided with the completely closed and approximately rectangular hollow sectional shape, a second-order section modulus thereof is large and the rigidity and the strength thereof are very high. Accordingly, even if the structural members are not so thick and the sizes of the same members are not so large, the locking portion 30 has a sufficient physical strength. Therefore, it is possible to reduce the size and the thickness of the housing 11, and it is possible to reduce the size and the weight of the cable connector 1.

In order to lock the actuator 21 at the closing position thereof or to unlock the actuator 21 at the closing position thereof, it is necessary that the locking portion 30 is elastically deformed and the locking projection 32 is elastically displaced in an outward direction of the housing 11 with respect to the locked portion 26 of the actuator 21.

In other words, according to the present embodiment, in the state that the actuator 21 is not locked as shown in FIG. 13 and in the state that the actuator 21 is locked as shown in FIG. 15, the locked portion 26 of the actuator 21 must be brought into contact with the locking projection 32 during shifting from one to the other state. Therefore, as shown in FIG. 14, unless the locking projection 32 is not elastically displaced in the outward direction of the housing 11, the actuator 21 can be shifted neither to the locked condition nor to the unlocked condition.

Therefore, it is necessary to facilitate elastic deformation of the locking portion 30 to some extent by lowering the rigidity of the locking portion 30, particularly, the rigidity on the region in the vicinity of the inlet side end to some extent.

Therefore, according to the present embodiment, as described above, the notch portion 38 is formed, and also any portion of the bottom plate portion 33 is not disposed in the inlet side end. Therefore, the rigidity in the region in the vicinity of the inlet side end of the locking portion 30 is lowered to some extent. As a result, by adjusting the size and the shape of the notch portion 38 and the size of the range where any portion of the bottom plate portion 33 is not disposed, the rigidity in the region in the vicinity of the inlet side end of the locking portion 30 can be freely appropriately adjusted. In addition, by adjusting the sizes and the shapes of the rigidity-adjustment projecting portion 34 and the rib portion 34*a*, the rigidity in the region in the vicinity of the inlet side end of the locking portion 30 can be further finely adjusted.

Incidentally, due to formation of the notch portion 38, it is possible to visually inspect the state that the bottom surface 82 of the auxiliary fitting 81 is connected to the surface of the substrate by soldering and the like from the outside of the side part of the housing 11. Therefore, also in the case of adjusting the rigidity of the locking portion 30, the sizes and the shapes of the notch portion 38 and the rigidity-adjustment projecting portion 34 are preferably determined to be large to thereby be able to visually inspect the connection state that the auxiliary fitting 81 is connected to the surface of the substrate.

Further, also by adjusting the size and the shape of the cavity portion 37, it is possible to adjust the rigidity in the region in the vicinity of the inlet side end of the locking portion 30. According to the present embodiment, as shown in FIG. 17, the cavity portion 37 may define the inlet side end of the auxiliary fitting accommodating recess portion 39. In this case, the auxiliary fitting accommodating recess portion 39 may hold the auxiliary fitting 81 by keeping in contact with the auxiliary fitting 81, but on the contrary, the cavity portion 37 is formed to be large enough for keeping in no contact with the auxiliary fitting 81 to be used for the attachment of the cable connector. The auxiliary fitting 81 is inserted from the front side of the housing 11 into the auxiliary fitting accommodating recess portion 39 to be mounted therein, so that the larger the cavity portion 37 is, more easily the operation for mounting the auxiliary fitting 81 can be achieved. However, in order to increase the rigidity in the region in the vicinity of the inlet side end of the locking portion 30, for example, when it is necessary to make the outside part 16 thicker, the size of the cavity portion 37 can be reduced.

Further, the rigidity in the region in the vicinity of the inlet side end of the locking portion 30 can be freely adjusted as required also by adjusting the sizes and the shapes of respective structural members such as the lock support arm portion 31, the inside part 35, the outside part 16, the bottom portion 33, and the inside step portion 17.

Thus, according to the present embodiment, the locking portion 30 is provided with the closed approximately rectangular hollow cross sectional shape. Therefore, with a simple structure, it is possible to increase the strength of the locking portion 30 and to reduce the thickness of the locking portion 30. In addition, it is possible to disperse the stress on the locking portion 30 to respective members, so that the durability of the locking portion 30 can be improved. Then, since the actuator 21 can be surely and reliably locked, the actuator 21 does not change its posture from the closing position unnecessarily. As a result, the actuator 21 can connect the FPC to the housing 11 with certainty. Further, the housing 11 can be reduced in the size and the weight and the connector 1 can be entirely reduced in the size and the weight.

In addition, the locking portion 30 may include a region having a hollow cross sectional shape with a partially opened portion. Hence, by lowering the rigidity in the region of the locking portion 30 to some extent, the locking portion 30 can be easily elastically deformed to some extent and this makes it possible to improve the operability when locking the actuator 21 in the closing position.

Further, the locking portion 30 has the locking projection 32 to be engaged with the locked portion 26 in the vicinity of the front end and the region having the hollow cross sectional shape with the partially opened portion is located in the vicinity of the front end. Therefore, the locking projection 32 can be elastically displaced with respect to the locked portion 26 of the actuator 21 and this enables to easily perform the operations to lock the actuator 21 in the closing position or to unlock the actuator 21.

Further, the outside part 16 may include the notch portion 38 formed in the approximately triangle shape, which is formed on the lower end at the inlet side. Therefore, by adjusting the size and the shape of the notch portion 38, the rigidity of the locking portion 30 can be freely appropriately adjusted.

Further, the auxiliary fitting 81 for attaching the connector is inserted in the cavity portion 37 and at least a part of the auxiliary fitting 81 can be visually inspected through the notch portion 38. Consequently, it becomes possible to visually inspect the state that the bottom surface 82 of the auxiliary fitting 81 is connected to the surface of the substrate by means of soldering and the like from the outside of the side part of the housing 11.

Further, the outside part 16 may include the rigidity-adjustment projecting portion 34 formed so as to project into the notch portion 38. Therefore, by adjusting the size and the shape of the rigidity-adjustment projecting portion 34, the rigidity of the locking portion 30 can be arbitrarily adjusted.

The present invention is not limited to the above-described embodiments, and may be changed in various ways based on the gist of the present invention, and these changes are not eliminated from the scope of the present invention.

What is claimed is:

1. A cable connector for receiving a flexible circuit member and for mounting on a substrate, comprising:

an insulative housing, the insulative housing including a receptacle for receiving the flexible circuit member therein, a plurality of terminal receiving cavities and a pair of end portions located at opposite ends of the insulative housing, the end portions including a pair of spaced apart walls to provide flexibility to at least one of the spaced apart walls, each spaced apart wall having a locking member thereon;

a plurality of conductive terminals, each conductive terminal being mounted in one of the terminal receiving cavities and configured to electrically connect to a conductive portion of the flexible circuit member; and an actuator, the actuator being mounted on the insulative housing and moveable between first and second operative positions, and including an actuator body generally extending along the receptacle when the actuator is in the second operative position and a pair of locking portions disposed on opposite ends of the actuator body;

wherein:

the cable connector is configured such that the flexible circuit member may be inserted into the receptacle when the actuator is in the first operative position;

the flexible circuit member is inserted into the receptacle and each conductive terminal engages the conductive portion of the flexible circuit member in an operative manner when the actuator is in the second operative position;

each locking member engages one of the locking portions when the actuator is in the second operative position; and each end portion further includes a hollow cross-sectional portion formed by an outside part, an inside part, a lock support arm portion connected to upper ends of the outside part and the inside part, and a bottom plate portion connected to lower ends of the outside part and the inside part.

2. The cable connector according to claim 1, wherein each spaced apart wall is interconnected along a surface extending from the locking member.

3. The cable connector according to claim 1, wherein the flexible circuit member is inserted into the receptacle generally in an insertion direction and each spaced apart wall extends generally perpendicular to the insertion direction.

4. The cable connector according to claim 1, wherein the hollow cross-sectional portion further includes a partially-opened portion including the outside part, the inside part, an inside stepped portion provided in the inside part, the lock support arm portion connected to upper ends of the outside part and the inside part, and a locking projection, formed at a corner portion where the lock support arm portion and the inside part are connected to each other, and adapted to be engaged with the locking portion of the actuator.

5. The cable connector according to claim 4, wherein the outside part includes an approximately triangular notch portion disposed in a lower end thereof.

6. The cable connector according to claim 5, wherein an auxiliary fitting for attaching the cable connector to the flexible circuit member is provided between the outside and inside parts.

7. The cable connector according to claim 4, wherein the outside part includes a rigidity adjustment projecting portion which projects into an area between the outside and inside parts.

* * * * *